United States Patent [19]

Van Erden et al.

[11] Patent Number: 4,840,611

[45] Date of Patent: Jun. 20, 1989

[54] GUSSETED BAGS WITH RECLOSURE FEATURES

[75] Inventors: Donald L. Van Erden, Wildwood, Ill.; Steven Ausnit, New York, N.Y.

[73] Assignee: Minigrip, Inc., Orangeburg, N.Y.

[21] Appl. No.: 139,969

[22] Filed: Dec. 31, 1987

Related U.S. Application Data

[62] Division of Ser. No. 799,790, Nov. 20, 1985, Pat. No. 4,736,450.

[51] Int. Cl.[4] ..... B31B 1/84

[52] U.S. Cl. ..... 493/213; 493/215; 493/232; 493/237; 493/927

[58] Field of Search ..... 493/213, 214, 215, 229, 493/232, 237, 218, 927, 936; 156/66

[56] References Cited

U.S. PATENT DOCUMENTS

| | | | |
|---|---|---|---|
| Re. 28,959 | 9/1976 | Naito | 29/450 |
| 476,803 | 6/1892 | Long | 383/81 |
| 1,011,866 | 12/1911 | Simmons | 383/95 |
| 1,236,159 | 8/1917 | Gatlin | 383/91 |
| 2,080,402 | 5/1937 | Herman | 383/95 |
| 2,319,127 | 5/1943 | Guenther et al. | 383/97 |
| 2,457,422 | 12/1948 | Warner | 383/120 |
| 2,780,261 | 10/1954 | Svec et al. | 150/3 |
| 3,054,434 | 5/1960 | Ausnit et al. | 150/3 |
| 3,077,820 | 2/1963 | Been | 493/214 |
| 3,181,583 | 5/1965 | Lingenfelter | 383/63 |
| 3,203,551 | 8/1965 | Van Loan | 383/91 |
| 3,410,327 | 4/1966 | Ausnit | 150/3 |
| 3,468,470 | 9/1969 | Sengewald | 383/120 |
| 3,780,781 | 12/1973 | Uramoto | 383/65 |
| 3,853,671 | 12/1974 | Ausnit | 156/580 |
| 4,000,768 | 1/1977 | Siegel | 383/63 |
| 4,174,597 | 11/1979 | Mowli et al. | 493/215 |
| 4,175,604 | 11/1979 | Bonner | 383/81 |
| 4,241,865 | 12/1980 | Ferrell | 156/66 |
| 4,372,793 | 2/1983 | Herz | 156/66 |
| 4,394,955 | 7/1983 | Raines et al. | 493/215 |
| 4,617,683 | 10/1986 | Christoff | 383/63 |

FOREIGN PATENT DOCUMENTS

| | | | |
|---|---|---|---|
| 90167 | 12/1960 | Denmark | 383/81 |
| 98822 | 10/1961 | Norway | 383/81 |
| 6433 | of 1912 | United Kingdom | 383/120 |
| 776382 | 6/1957 | United Kingdom | 383/120 |
| 2037704 | 7/1980 | United Kingdom | 383/65 |

*Primary Examiner*—Frederick R. Schmidt
*Assistant Examiner*—Robert Showalter
*Attorney, Agent, or Firm*—Hill, Van Santen, Steadman & Simpson

[57] ABSTRACT

Gusseted bags are provided with extruded reclosable plastic profile strips along free upper end portions of face walls flanking a bag mouth, the fastener strips being free to separate throughout their lengths when opening the bag mouth to the full extent permitted by opposite side expanding gussets of the bag so that free access into the bag such as for inserting or removing contents such a tray loaded with products such as cookies, or the like, or for pouring contents therefrom selectively between either of the separated ends of the upper end portions of the face walls and the corresponding ends of the fastener strips is permitted. The fastener strips may have interlockable wraparound extensions. A method of making the bags is disclosed.

3 Claims, 3 Drawing Sheets

FIG. 1
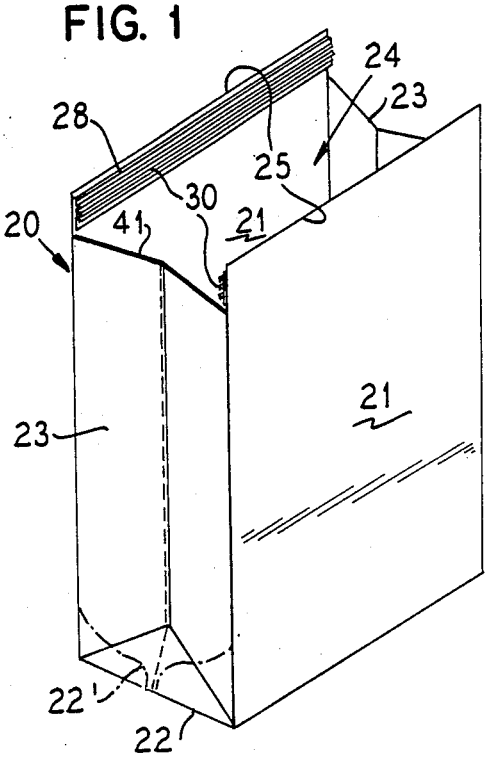
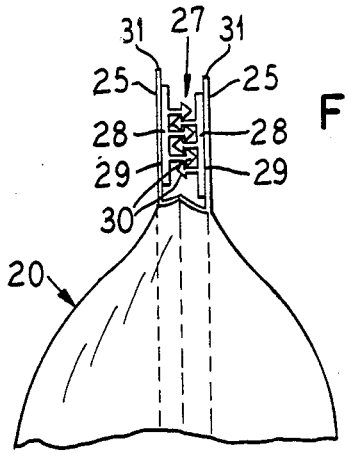
FIG. 2
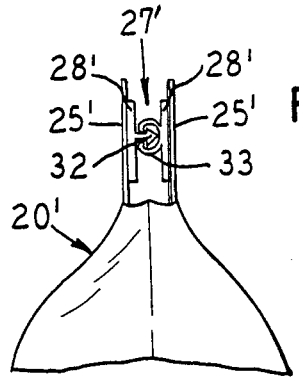
FIG. 3
FIG. 4
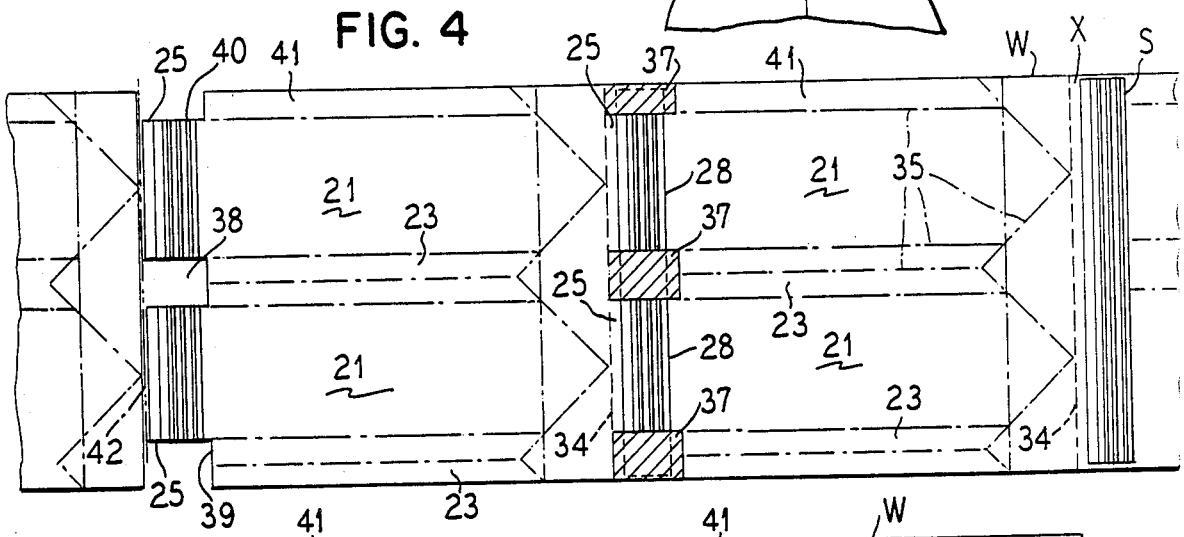
FIG. 5
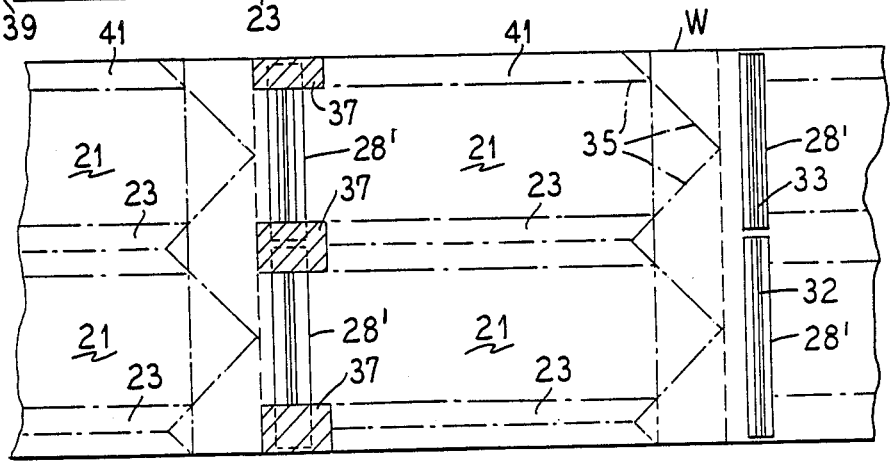

GUSSETED BAGS WITH RECLOSURE FEATURES

This is a division, of application Ser. No. 799,790, filed 11/20/85 now U.S. Pat. No. 4,736,450 dated Apr. 5, 1988.

BACKGROUND OF THE INVENTION

FIELD OF THE INVENTION

This invention relates to reclosable bags, and is more particularly concerned with gusseted bags having reclosure features, that is bags equipped with reclosable fasteners.

There have been various and sundry reclosable bag structures provided heretofore among which are the well known type formed from plastic film or other bag wall material equipped with reclosable fasteners inwardly from their mouth ends, and sealed closed along their sides and bottom ends. The fasteners which comprise complementary rib and groove resiliently flexible extruded fastener profiles along the mouth ends of the bags are also secured together at their ends in line with the side seals for the bags. Bags of this type may be formed from integrally extruded fastener and film as exemplified in U.S. Re. Pat. No. 28,969 and 3,410,327.

On the other hand, the bags may be formed from separately fabricated bag making sheet material and preformed extruded reclosable fastener strips as exemplified in U.S. Pat. Nos. 3,853,671 and 4,372,793, and bag U.S. Pat. Nos. 2,780,261, 3,054,434, 3,780,781.

None of the bags then equipped with separable extruded fasteners have gussets along their sides, and for some uses gusseted bags may be perferred because of their greater contents volume capacity.

While gusseted bags of the grocery bag type are well known, we are not aware of any such bags having heretofore been provided with reclosable fasteners in a manner to permit full opening of the gusseted sides of the top or mouth openings of the bags. For example, in U.S. Pat. No. 4,241,865 there is a disclosure involving bags of either closed seam sides or gusseted sides and equipped with slider operated toothed zippers. However, the zippers are necessarily maintained closed at one end, that is at one side of the bag so that the sliders will remain operative, and therefore freedom for access into the bag or pouring from the bag is restricted to just one side of the bag.

SUMMARY OF THE PRESENT INVENTION

An important object of the present invention is to provide a reclosable fastener-equipped gusseted bag structure which can be opened throughout the width of the mouth end of the bag between side gussets.

Another object of the invention is to provide a bag of the type indicated in which the reclosable fastener comprises extruded plastic profile strips.

A further object of the invention is to provide a new and improved method of making such a bag.

Yet another object of the invention is to provide a bag of the type indicated in which reclosable fastener means is equipped to retain the top of the bag in rolled down condition after part of the bag contents have been used up.

In accordance with the principles of the present invention there is provided a bag having opposite face wall panels connected by a closed bottom, opposite side expanding gussets, and a top opening providing a bag mouth. Upper free end portions of the face wall panels flank the bag mouth. The entire lengths of the free portions across the width of the bag are separable from a mouth-closing face-to-face contiguity into a bag mouth open separation up to the full expansion of the gussets. A fastener is provided comprising complementary extruded reclosable plastic profile strips on the free end portions of the wall panels for holding the free end portions closed in their bag mouth closed contiguity. The fastener strips are separable throughout their lengths for separating the face wall end portions into bag mouth open relation, thus permitting the entire lengths of said end portions to separate to the full extent of the gusset expansion and leaving the bag mouth in line with both gussets free and fully expanded for access into the bag, such as for taking out a tray of cookies or similar products that require substantially the full mouth opening or for pouring contents therefrom selectively between either of the separated ends of said end portions and the corresponding ends of said fastener strips.

A method of making such a bag is also disclosed.

BRIEF DESCRIPTION OF THE DRAWINGS

Other objects, features and advantages of the invention will be readily apparent from the following description of representative embodiments thereof, taken in conjunction with the accompanying drawings, although variations and modifications may be effected without departing from the spirit and scope of the novel concepts embodied in the disclosure and in which:

FIG. 1 is a perspective view of a gusseted bag embodying the present invention.

FIG. 2 is a fragmentary side elevational view of the bag of FIG. 1 with the reclosable fastener closed.

FIG. 3 is a view similar to FIG. 2 but showing another type of reclosable fastener profile.

FIG. 4 is a schematic view related to a method of making the bag of FIGS. 1 and 2.

FIG. 5 demonstrates a method of making the bag of FIG. 3.

DETAILED DESCRIPTION

Figure 6:
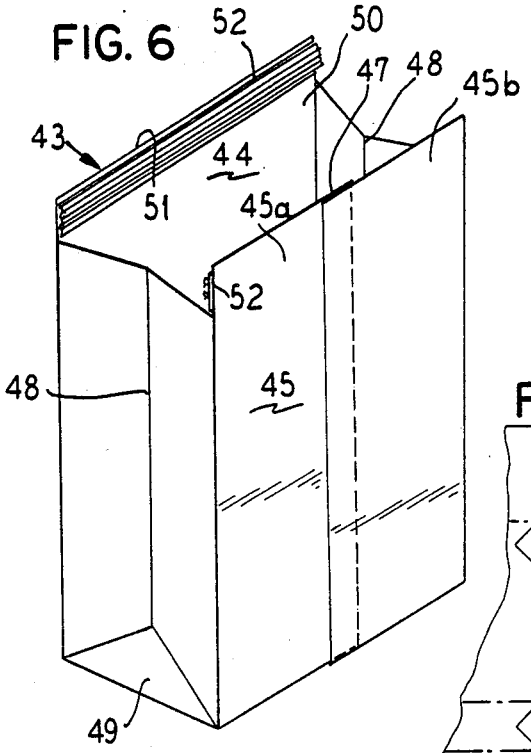
FIG. 6 is a perspective view of a modified form of the gusseted bag body itself.

Referring first to FIGS. 1 and 2, a bag 20 is depicted having opposite face walls 21 connected by a closed bottom 22 which may be of the square bottom form shown in full outline or the pinched bottom form 22' shown in dot dash outline, wherein the lower end of the bag is pinched together and sealed entirely across the width of the bag. At the opposite sides of the bag infoldable vertical expanding gussets 23 connect the face walls 21 and permit the bag to expand from a flat condition as indicated in dash outline in FIG. 2, into the filled bag condition exemplified in full outline in FIG. 2. A top opening in the bag provides a mouth 24. Upper free end portions 25 of the face walls 21 flank the bag mouth 24 and extend above the gussets 23. The entire length of the free end portions 25 across the width of the bag are separable from a mouth closing face-to-face contiguity, as shown in FIG. 2, into a bag mouth open separation up to the full expansion of the gussets 23, as shown in FIG. 1.

A separable fastener 27 for the bag top comprises complementary extruded reclosable plastic profile strips 28 on the upstanding free end portions 25, and more particularly on the inner sides of such end portions. The profile strips hold the free end portions 25 closed in the bag mouth closing contiguity as shown in FIG. 2 and the strips 28 are separable throughout their lengths for separating the end portions into bag mouth open relation as shown in FIG. 1. In this instance (FIGS. 1 and 2) the fastener strips 28 are of substantially identical complementary structure, each comprising a base which is secured as by means of fusion or adhesive bonding 29 to the inside surface of the upper portion 25 to which attached. Projecting oppositely to the base surfaces of the fastener strips 28 are respective separable interlockable ribs 30 which are shown as of generally arrow head shape and plural in number, such as three, although less or more of the ribs 30 may be provided, depending upon the size and conditions of use of the bag 20. The arrangement is such that the fastener ribs 30 on the confronting fastener strips 28 are releasible interlockable, as shown in FIG. 2, when pressed together. To separate the fastener strips, digital separating pressure applied to pull flange extremities 31 on the bag wall portions 29 will, in effect, peel the fastener 27 open.

A desirable attribute of the present construction is that when the strips 28 of the fastener 27 are separated, the entire lengths of the end portions 25 are permitted to separate to the full extent of the expansion of the gussets 23. This leaves the bag mouth in line with the gussets free for access into the bag, such as for inserting or removing a tray loaded with products such as cookies or the like, or for pouring contents therefrom selectively between either of the separated ends of the end portions 25 and the corresponding ends of the fastener strips 28 which are fully separable and not attached to one another, as exemplified in FIG. 1.

One of the advantages of having an equal number of the fastener profiles 30 on each of the strips 28 is that when the fastener profiles are interlocked as shown in FIG. 2, one of the upper portions 25 of the bag may be offset upwardly relative to the other, whereby to facilitate grasping and separation pulling of the pull flanges 31.

In the modified bag 21' of FIG. 3, all structural features of the bag may be the same as in the bag 20 of FIGS. 1 and 2, except that the reclosable fastener 27' comprises fastener strips 28' which have their base surfaces secured to the upper free end portions 25' in similar fashion as the base surfaces of the fastener strips 28, but the separably interlockable profiles on the strips 28' comprise on one of the strips a generally arrow head shaped fastener rib 32 which is interlockably received in a generally groove shaped fastener rib 33 on the other strip 28'. It wil understood, of course, that any other preferred profile shape may be used in respect to the profile strips 28, 28'.

The bag 20 can be mass produced effeciently in a continuous online manner by feeding a continuous length web W (FIG. 4) of the bag body material along a production path. Fastener strip means in the form of strip sections S are secured to and across the web W at uniform bag length intervals in suitably spaced parallel relation to what will become the top edges of respective pull flange area X, and from which the next preceeding bag blank will be severed along a line indicated by a dash line 34. The fastener strip sections S may be applied across the web W according to teachings in the copending application of Christoff and Ausnit U.S. Ser. No. 574,878, filed Jan. 30, 1984, and assigned to the same assignee as the present application.

Adjacently upstream from each of the fastener strips S, the web W is desirably creased, if that is practical in respect to the particular structure of the web W, to facilitate subsequent shaping, assemblying and folding of each of the bags 20. The fold lines are identified by the dot dash lines 35. If the material of the web W is not susceptible to precreasing, the creasing and folding may be effected at the time the bag blank is shaped and secured into the tubular bag form.

In order to provide for the separation of the fastener strip S into the cooperative fastener strips 28 and the wall extensions 25 carrying the same, the fastener strip carrying end portion of each of the bag sections of the web W is punched out by means such as cooperating punches 37 to remove from the web W and the fastener strip S, those portions which are in line with the portions of the web which will provide the gussets 23 in the completed bag. In each of the bag blanks, after the punching operation, a cutout area 38 will be aligned with what will be the gusset 23 foldably located between the wall panels 21. Along one side of the web W, a cutout area 39 will appear in line with the fold for the remaining gusset 23, while at the opposite side of the web, a cutout area 40 will be aligned with an attachement flange 41 which is coextensive with the gusset folds, and in the tubular formation of the bag is attached to the free wing of the gusset formed up from the gusset fold material at the opposite side of the web from the flange 41. After the cutout areas 38, 39 and 40 have been completed on each successive bag blank, each completed blank is severed from the succeeding blank by suitable cut off means represented by the double-dot dash line 42.

In FIG. 5 is shown the same arrangement as in FIG. 4 except that the zipper strips 28' are involved. For this purpose, two of the zipper strips are applied in end-to-end relation across the web W, one of the strips 28' having the fastener profile 32 thereon and the other having the profile 33 thereon. Otherwise the folding, the punching out, and the severence of the web into individual bag blank sections is the same as described in FIG. 4.

Figure 8:
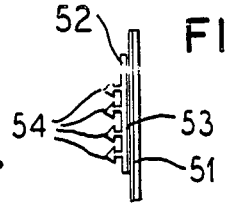
FIG. 8 is a fragmentary sectional view taken substantially along the line VIII—VIII in FIG. 7.
Figure 7:
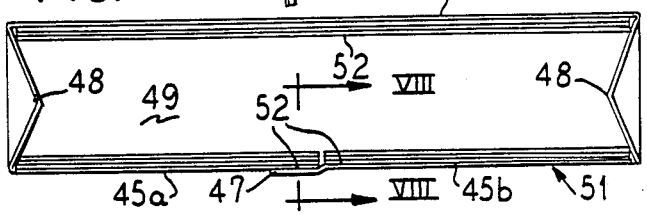
FIG. 7 is a top plan view of the bag of FIG. 6.

In FIGS. 6 and 7, a gusseted bag 43 is shown having one solid face wall panel 44, and an opposite face wall panel 45 which is made up of half panels 45*a* and 45*b* secured together by a longitudinal lap joint 47. The wall panels 44 and 45 are connected along their sides by expanding gussets 48, while the bottom end of the bag is closed by a closed bottom 49. A top opening provides a bag mouth 50. Upper free end portions 51 of the face wall panels 44 and 45 project above the gussets 48 and flank the bag mouth 50. The entire lengths of the free portions 51 across the width of the bag are separable from a mouth closing face-to-face contiguity into a bag mouth open separation up to the full expansion of the gussets 48. Fastener strips 52 are secured by suitable bonding means 53, (FIG. 8), to the respective free portions 51. Although the fastener strips 52 may be equipped with profiles in either of the forms as shown in FIGS. 2 and 3, they are shown, as best seen in FIG. 8, as of the parallel plural arrow head shaped form.

Figure 9:
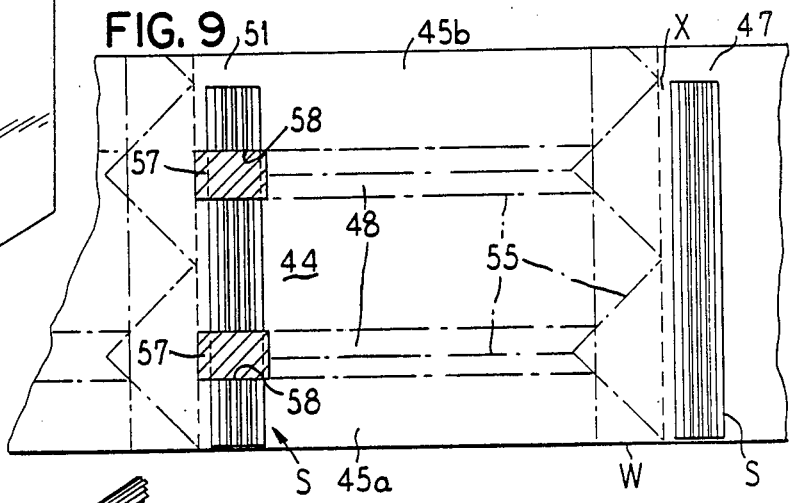
FIG. 9 is a schematic view illustrating a method of making the bag of FIG. 6.

The method of making the material for the bag 43 may be similar to that described in connection with FIGS. 4 and 5, except that provision must be made for the substantially center panel lap joinder of the half panels 45*a* and 45*b* of the bag tube. To this end, the layout on the web W for each bag blank is such that the zipper strip S is aligned at one end substantially at one edge of the web W, while its opposite end the zipper strip is suitably spaced from the edge of the web adjacent thereto to provide for the outer lap of the lap joint 47. In this instance, fold lines 55 for delineating the gussets 48 and the bag wall bottom 49, are so arranged in respect to the solid wall panel 44, and the two parts 45*a* and 45*b* of the wall panel 45, that when punches 57 punch out areas 58 across the zipper strip S the separated lengths of the zipper strip will be properly oriented for cooperative fastener relationship when the bag tube is completed. That is, as shown in FIGS. 6, 7 and 9, a portion of the zipper strip S will provide the zipper strip 52 for the top portion 51 of the wall panel 44. Respective portions of the zipper strip S will extend across the upper portions 51 of the wall panel parts 45*a* and 45*b*, so that when those wall panel portions are brought into the over-lapped joinder 47, the fastener strip portions on the thus assembled wall panel portions 45*a* and 45*b* will, as best seen in FIG. 7, be in closely related end-to-end relation. This provides, in effect, a complete functioning fastener strip 52 cooperatively related to the opposite fastener strip 52 for providing a complete reclosable fastener assembly.

Figure 10:
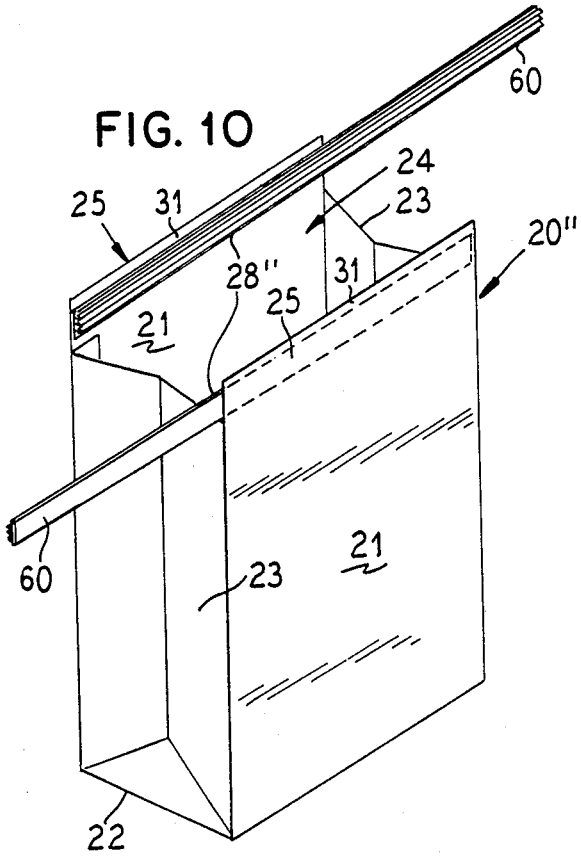
FIG. 10 is a bag similar to FIG. 1 but showing a modification in the reclosable fastener structure.
Figure 11:
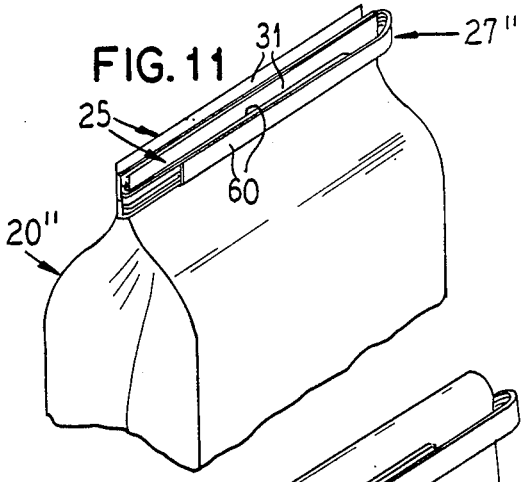
FIG. 11 is a fragmentary perspective view of the upper portion of the bag of FIG. 10 with the reclosable fastener closed and providing a retaining loop for the closed bag top.
Figure 12:
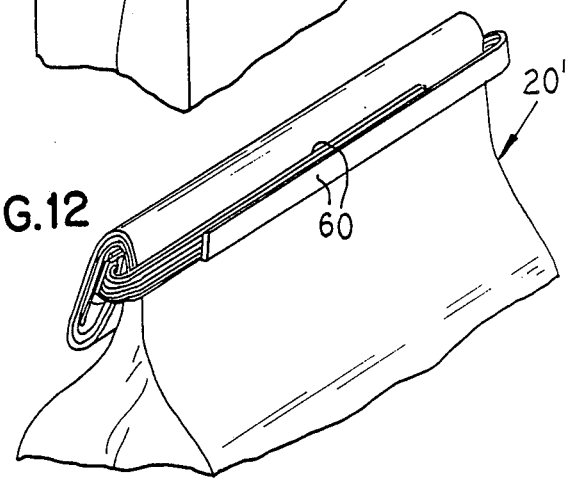
FIG. 12 is a view similar to FIG. 11 but showing the top of the bag rolled down.

In FIGS. 10, 11 and 12, a modification 27″ of the fastener 27 in FIGS. 1 and 2 is depicted. The difference resides, in that the fastener strips 28″ in FIG. 10 have respective wraparound extensions 60 extending in respectively opposite directions. When the fastener 27″ is closed as shown in FIG. 11, the extensions 60 upon being wrapped around the closed bag top can be snapped together and when interlocked, as shown, will serve as retainers to resist opening of the bag mouth 24. In particular, as the contents of the bag 20″ are progressively depleted, the reclosable fastener closed bag top can be rolled down upon itself as shown in FIG. 12, and the fastener extensions 60 wrapped around and interlocked to maintain the rolled top condition. This provides a safety feature against spillage from the closed bag and also against intrusion of undesirable objects, dust and the like or other contamination, and assists in maintaining freshness, where that is a consideration, by maintaining the bag top reasonably closed against air intrusion.

Figure 13:
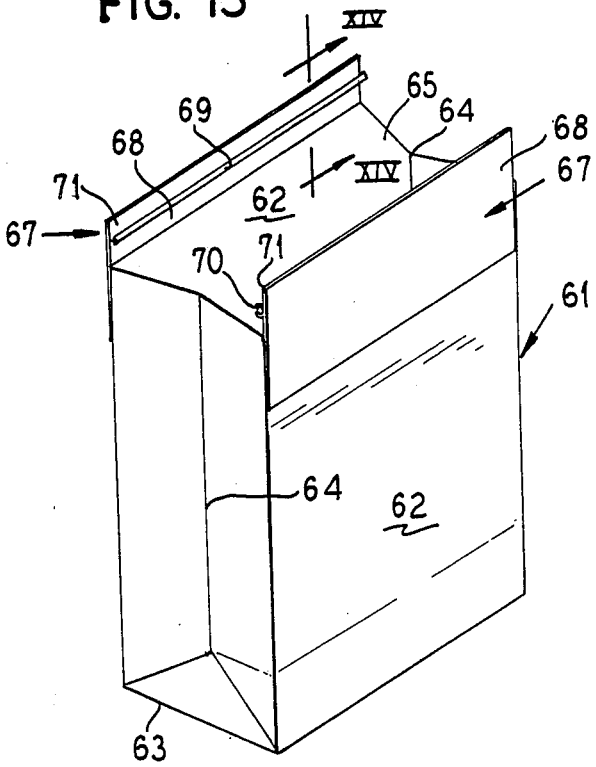
FIG. 13 is a perspective view of a gusseted bag having still another form of the reclosable fastener.
Figure 14:
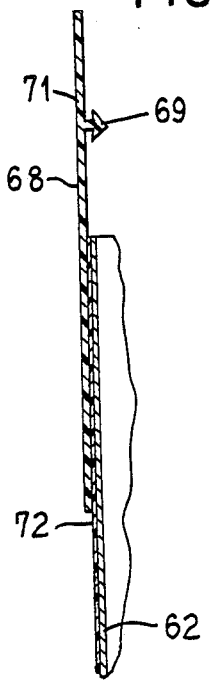
FIG. 14 is a fragmentary sectional detail view taken substantially along the line XIV—XIV in FIG. 13.
Figure 15:
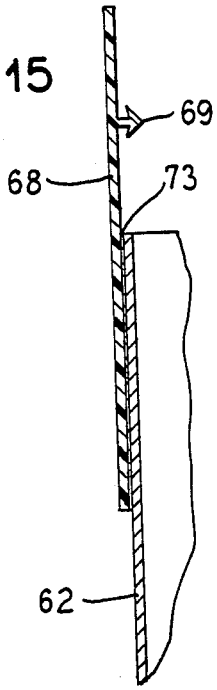
FIG. 15 is a view similar to FIG. 14 but showing a different mode of attachment of the reclosable fastener strip.

In the modification shown in FIGS. 13, 14 and 15, a gusseted bag 61 of conventional form has face wall panels 62 connected by closed bottom 63. The opposite sides of the walls 62 are connected by expanding gussets 64, and a top opening provides a bag mouth 65 which when the bag is open is adapted to expand to the full extent of expansion of the gussets 64. In this instances, upper free end portions of the face walls 62 are provided by the width of fastener strips 67 which are secured to and project upwardly from the upper edges of the walls 62. In this instance the wall edges are of substantially the same height as the upper ends of the gussets 64. Thus, the fastener strips 67 are adapted to be applied to conventional stock gusseted bags for converting such bags into reclosable bags.

Desirably, the fastener strips 67 comprise base flanges 68 of substantial width and of a length to extend throughout the width of the associated side wall 62. Respective lower portions of the flanges 68 are secured to the upper free end portions of the face walls 62. Desirably, the lower portions of the fastener flanges 68 are wider than the upper portions to provide ample area for secure attachment to the upper margins of the walls 62. Preferably the flanges 68 are attached to the outer surfaces of the walls 62. The arrangement is such that substantial upper width areas of the flanges 68 project above and, in effect, provide upward extensions of the side walls 62 projecting above the upper ends of the gussets 64.

On the upper portions of their inner faces, the fastener flanges 68 have complementary separable fastener profiles which may be of any desired form, but are shown herein as of the tongue and groove type comprising a generally arrow head shaped profile rib 69 on one of the fastener strips 67 and a groove shaped complementary profile 70 on the other of the fastener strips 67. The profiles 69 and 70 are aligned opposite one another so that by pressing the fastener strips 67 toward one another, the profiles will match and can be snapped into interlocking relation for closing the bag mouth 65 in the manner and for the purpose described in connection with FIGS. 1–3. It may be noted that the fastener strip base portions 68 have extensions 71 above the respective profiles 69 and 70 and such extensions will serve as pull flanges to facilitate digitally separating, that is opening the fastener when desired.

As best seen in FIG. 14, the material in the body of the bag 61 may comprise primarily paper which may have a coating 72 at least on the areas thereof to which the zipper bases 68 are secured to facilitate attachment of the fastener strips. For example, where the fastener strips are of extruded thermoplastic material, the coating may be of the same or a fusibly compatible material so that the fastener strips 67 can be secured to the bag walls 62 by fusing energy applied to the composite so that the layer 72, in effect, provides a bonding agent for securing the associated fastener flanges 68 to the bag wall area.

If preferred, and especially where the material of the bag body is not equipped for fusibly attaching the fastener base flanges 68 to the upper end portions of the bag wall 62, adhesive 73 (FIG. 15) may be employed as the bonding agent for securing the fastener flange 68 to the bag wall 62 in each instance.

Where it is desired to fill the bags in a vertical form fill machine, bag blanks for providing the sealed bottom 22′ of FIG. 1 may be supplied in a continuous strip which is fed to and about the vertical filling nozzel of the machine. Such blanks will, of course, have if practical preformed fold lines for the gussets and wall panels. On the vertical filling nozzle the bag tube will be joined and sealed as is conventional. Below the end of the nozzle gusset folding and combined conventional cross sealing and pull down means will operate.

It will be understood that variations and modifications may be effected without departing from the spirit and scope of the novel concepts of the present invention.

We claim as our invention:

1. A method of making bags having opposite face wall panels connected by a closed bottom, opposite side expanding gussets, and a top opening providing a bag mouth, comprising:

providing a web of a length from which a plurality of bags can be produced by separating the web across its length into bag length sections;

securing across the web on axes extending between opposite longitudinal sides of the web and at bag mouth ends of said bag length sections fastener strips comprising extruded reclosable plastic profiles;

and punching out portions of the web and the secured fastener strips aligned with areas of the web to be formed into said expanding gussets;

and leaving lengths of the fastener strips on portions of the web which will form free end bag mouth portions of face wall panels of the bag length sections and which face wall panels are foldable onto one another along a line which extends across said fastener strip axes.

2. A method according to claim 1, which includes outlining on said web and parallel to said longitudinal sides various fold lines on each bag length.

3. A method according to claim 1, comprising applying said fastener strips to the web in end-to-end fastener strip sections in sets wherein the fastener strip sections are longitudinally aligned with one another on said axes and with one section of each set on one of said face wall panels and another section of each set on another of said face wall panels, and providing each of said sections in each set with a different but complementary profile relative to the other section in each set so that in the folded relation of the face wall panels in the bag the fastener section profiles are interlockable with one another.

* * * * *